US005531873A

United States Patent [19]

Pulliainen et al.

[11] Patent Number: 5,531,873

[45] Date of Patent: Jul. 2, 1996

[54] ELECTRODE ARRANGEMENT TO BE USED IN THE CATHODIC PROTECTION OF CONCRETE STRUCTURES AND A FIXING ELEMENT

[75] Inventors: Martti Pulliainen, Anttola; Tarja Haapamäki, Töysä both of Finland

[73] Assignee: Savcor-Consulting Oy, Mikkeli, Finland

[21] Appl. No.: 250,476

[22] Filed: May 27, 1994

Related U.S. Application Data

[63] Continuation of Ser. No. 834,297, Feb. 19, 1992, abandoned.

[30] Foreign Application Priority Data

Jun. 20, 1990 [FI] Finland ..... 903119

[51] Int. Cl.[6] ..... C23F 13/00

[52] U.S. Cl. ..... 204/196; 204/284; 204/286; 205/734

[58] Field of Search ..... 204/130, 147, 204/148, 196, 197, 284, 286

[56] References Cited

U.S. PATENT DOCUMENTS

| | | | |
|---|---|---|---|
| 2,934,485 | 4/1960 | Sabins | 204/286 |
| 3,011,959 | 12/1961 | Anderson | 204/196 |
| 3,058,086 | 10/1962 | Zwanzig | 204/196 |
| 3,101,311 | 8/1963 | Preiser et al. | 204/196 |
| 3,625,851 | 12/1971 | Geld | 204/196 |
| 3,677,929 | 7/1972 | Young | 204/284 |
| 4,013,525 | 3/1977 | Emsley | 204/284 |
| 4,193,858 | 3/1980 | Loeffler | 204/284 |
| 4,196,069 | 4/1980 | Mose et al. | 204/257 |
| 4,252,628 | 2/1981 | Boulton et al. | 204/284 |
| 4,692,066 | 9/1987 | Clear | 204/196 |

FOREIGN PATENT DOCUMENTS

| | | |
|---|---|---|
| 0262835 | 4/1988 | European Pat. Off. . |
| 3826926 | 2/1990 | Germany . |
| 8606759 | 11/1986 | WIPO . |
| 8910435 | 11/1989 | WIPO . |

*Primary Examiner*—T. Tung
*Attorney, Agent, or Firm*—Steinberg, Raskin & Davidson

[57] ABSTRACT

The invention relates to a method for fixing an electrode arrangement to be used in the cathodic protection of concrete structures. In the method, an anode (20) is mounted in a framework (11) and the framework with its anodes is mounted on the concrete structure at a production plant or in the mounting step before the concreting step. The invention also relates to a fixing element (10) of the electrode arrangement to be used in the cathodic protection of concrete structures, which fixing element is comprised of an anode (20) and a framework (11), which framework (11) is provided with means (15) for fixing the element (10) to the concrete structure.

13 Claims, 2 Drawing Sheets

FIG. 1A
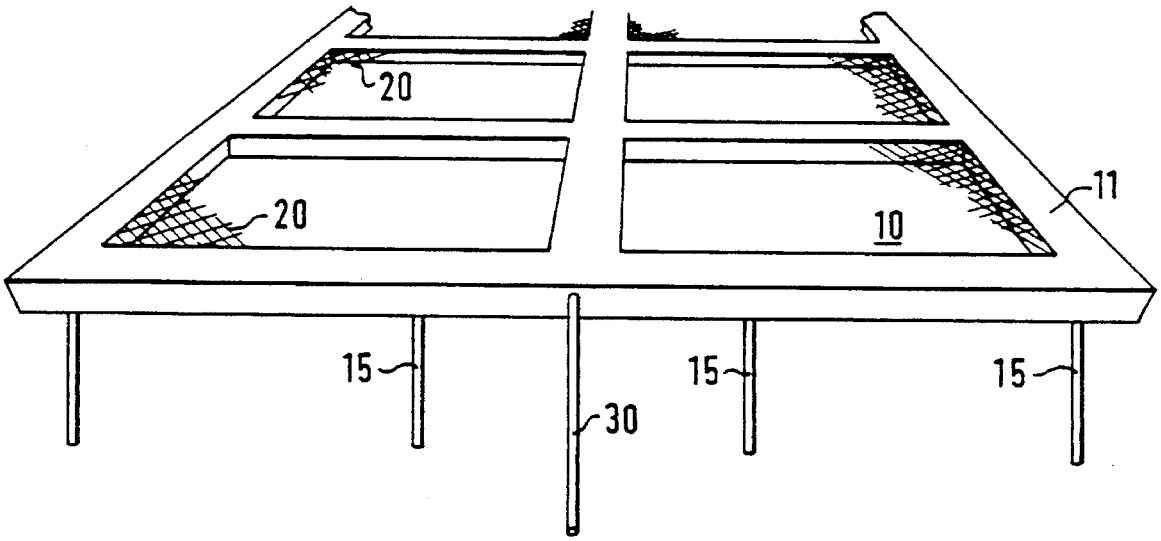
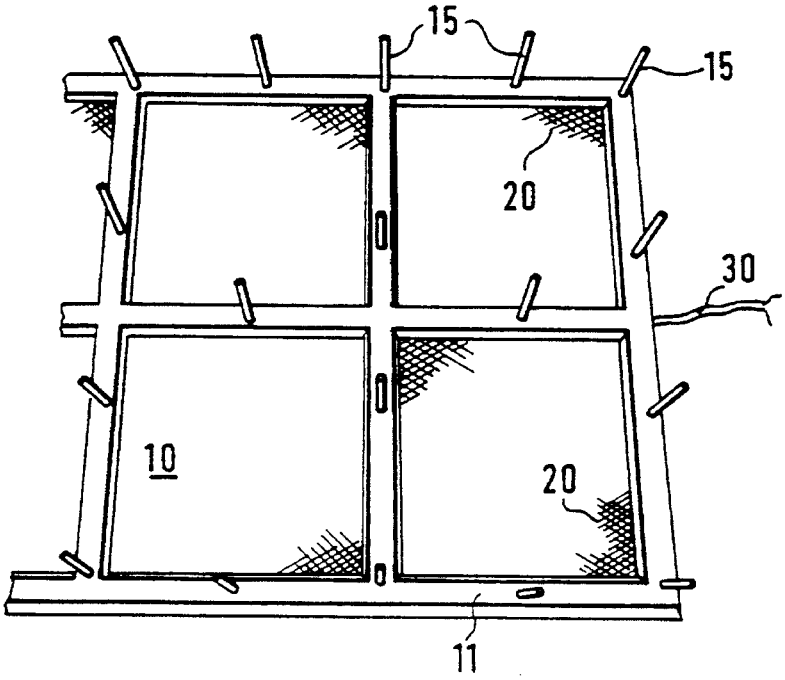
FIG. 1B

ELECTRODE ARRANGEMENT TO BE USED IN THE CATHODIC PROTECTION OF CONCRETE STRUCTURES AND A FIXING ELEMENT

This is a continuation, of application Ser. No. 07/834,297, filed Feb. 19, 1992, now abandoned.

BACKGROUND OF THE INVENTION

The invention relates to a method for fixing an electrode arrangement to be used in the cathodic protection of concrete structures.

The invention also relates to a fixing element of an electrode arrangement to be used in the cathodic protection of concrete structures.

OBJECTS AND SUMMARY OF THE INVENTION

In the protection of steel parts of concrete structures, e.g., concrete reinforcements, the anodes of an electrode arrangement are generally fixed to an existing concrete surface, and the anode is covered with shotcrete or with another corresponding conductive material. However, problems have been caused by the poor fixability of the electrode arrangement during the casting. Additional problems have also been caused by the fact that the anode is during the casting bent into contact with the steel constructions to be protected.

The above-mentioned situtations have made it considerably more difficult and slower to carry out the actual concrete casting.

The object of the present invention is to provide such an anode fixing arrangement and method, which, when used, eliminates the above-mentioned problem situations.

Another object of the invention is to provide such a fixing arrangement, which well adapts itself to be used in continuous concreting applications.

For reaching the objects mentioned above and to be presented below, the inventive method is mainly characterized in that the anode is mounted in a framework and that the framework with its anodes is mounted on the concrete structure at a production plant or in the mounting step before the concreting step.

The inventive fixing element is mainly characterized in that the fixing element is comprised of an anode and a framework, which framework is provided with means for fixing the element to the concrete structure.

Such an inventive anode element placed in position before the concreting is in certain cases the only technically sensible solution. When, for example, protecting underwater concrete structures, a considerable advantage is obtained in the preparation step, when the anode arrangement is of an element-structional type.

When using the inventive anode fixing arrangement, the pressing effect of the additional mass caused by shotcreting is avoided. Furthermore, the number of the work phases needed decreases, since the anode element is prefabricated, and only the fixing of the anode element has to be performed in connection with concreting.

The fixing of the inventive element is easy and it saves mounting time, since a separate fixing and insulating work of the anode in the mounting step is eliminated.

The inventive element remains fixed on the concrete structures, whereby no special precautionary measures are needed in the concreting step, e.g., it is not necessary to use a slower concreting rate.

The construction of the anode element according to the invention is mechanically rigid such that it cannot come into an electrical contact with the concrete reinforcements to be protected. From the point of view of the operation of the protection, the avoidance of the electrical contact is one of the basic prerequisites. In addition, the inventive anode element cannot move during the concreting owing to its fixing means.

When using the inventive element, the uninterruptibility of a cathodic contact is also ensured, since the connection of all concrete reinforcement layers to the cathode circuit can be guaranteed by means of several fixing points.

The anode element according to the invention forms a system of several elements such that each element can, when so desired, be controlled as a separate electric circuit. The operation of the anode system is thereby ensured.

In a preferred embodiment of the invention, the apparatus is used in the casting of a cast reinforced concrete structure to provide cathodic protection of reinforcing members of a concrete structure, and comprises at least one anode having opposed sides and a lateral periphery bordering the sides, a framework connected to the anode substantially at the lateral periphery thereof such that the sides of the anode are uncovered by the framework and openly exposed, and means for fixing the framework to at least one reinforcing member of the concrete structure to be cast prior to casting the concrete structure. The framework and anode constituting an anode element is thus connected to the reinforcing member(s) to form an assembly which is situated in a space for receiving poured concrete during the casting of the concrete structure. In this manner, upon the casting of the concrete structure, the sides of the anode, the framework and the reinforcing member(s) are all encapsulated in an integral mass of the concrete of the concrete structure.

BRIEF DESCRIPTION OF THE DRAWINGS

The invention is next described in more detail with reference to the figures of the accompanying drawing, to which the invention is, however, in no way narrowly limited.

FIG. 1A and 1B show schematically an inventive anode element.

DETAILED DESCRIPTION OF THE INVENTION

Figure 2:
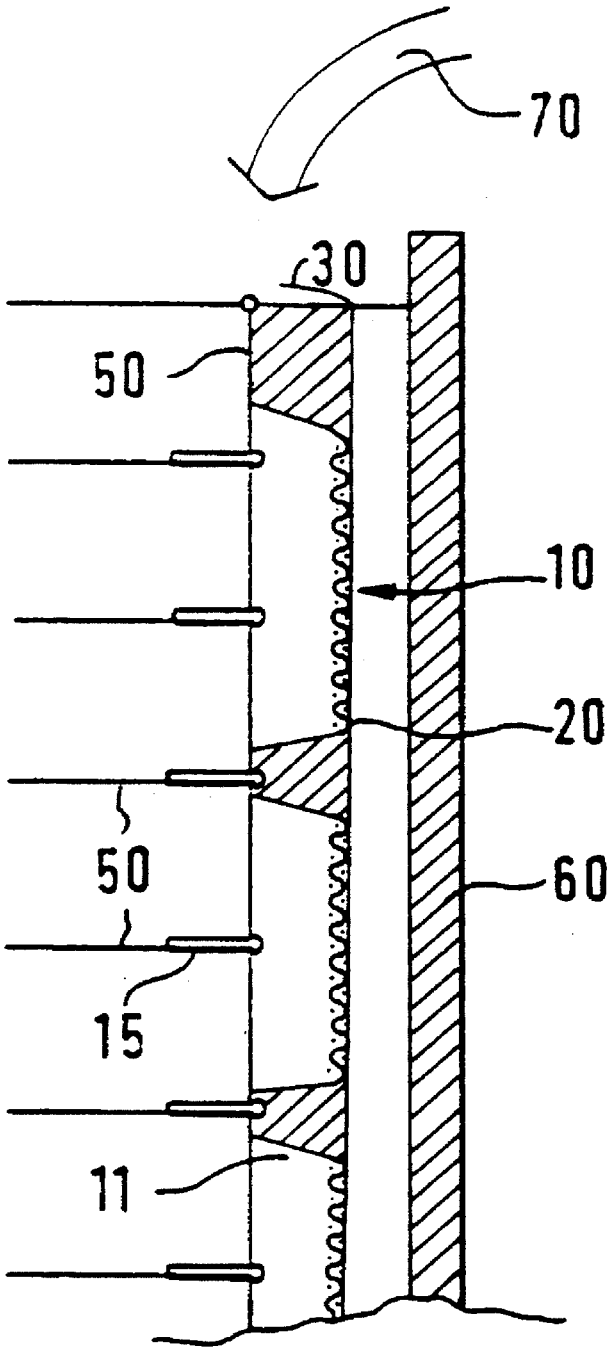
FIG. 2 shows as a schematic partial view an inventive anode element fixed to a concrete structure.

An inventive anode element 10 shown in FIG. 1A and 1B comprises a framework 11, anodes 20 and fixing means 15. The framework 11 is made of an electrically insulating material, e.g., of plastics or ceramics or of an electrolytically conductive material, e.g., of concrete, plastics or ceramics. When so desired, a steel reinforcement or some other reinforcement is used for improving the strength properties of the framework 11, which is, however, not necessary.

In one preferred embodiment of the invention, the framework 11 of the anode element 10 is made of concrete, since a good adherence to the concreting is then obtained. Furthermore, when the framework 11 is made of concrete, possible detrimental heat expansion phenomena are eliminated.

The anode element 10 is fixed to a concrete surface, to concrete reinforcements or to other fixed parts of the construction or to parts used during the mounting with the fixing means 15 of the framework 11, e.g., with plastic hooks, nails, wires, screws or the like.

The fixing means 15 shown in FIG. 1A and 1B are made of concrete reinforcement pins, which are fixed to the concrete reinforcements of the actual concrete reinforcement structure. Thus, the fixing means 15 are attachable to the steel parts and serve to define a continuous open space into which concrete is to be poured. The anode 20 and the steel parts of the structure are situated in this continuous open space before concrete is poured therein such that a uniform and continuous concrete structure is formed between the anode 20 and the steel parts upon pouring of concrete into the continuous open space.

The anode 20 is placed in the concreting of the framework 11, or the anode 20 is mechanically fixed e.g., with metallic or plastic nails, screws, anchors, lists or the like to the framework 11.

The anode 20 is located on the opposite side relative to the fixing means 15 of the framework 11.

The anode 20 is a net, wire, strip, rod, plate or the like.

The material used in the anode 20 is a composite material, e.g., an alloy-metal coated titan, magnetite, platinated titan or an iron mixture, e.g., ferrosilicon or graphite or a noble metal, e.g., platinum or a conductive plastic.

As described above, the anode element 10 can either be comprised of the material of the anode 20 or of the material of the anode 20 and another material joined thereto. Several anode elements 10 form a system, by means of which the steel parts of the concrete structure can be cathodically protected. Electricity is supplied to the anode element 20 e.g. via a conductor 30. The electricity is supplied separately to each anode element 20 via one or more of its points or to all anode elements 20 of the system together or by means of some combination of the two separate above-mentioned systems.

The framework 11 of the anode element is arranged in a wedge-like form such that the width of the crosspiece of the framework 11 is on the side of the anode 20 greater than on the side of the fixing means 15, whereby the concrete can during the casting easily flow also inside the framework.

In accordance with FIG. 2, the anode element 10 is fixed to the steel parts 50 of the concrete reinforcement structure so that the fixing means 15 of the anode element 10 are fixed to the steel parts 50. The anode element 10 is fitted between the outermost concrete reinforcement layer and the concreting wood lining 60, or wood lined mold, into which the concrete 70 is cast.

As shown in FIG. 2, the anodes 20 of the anode element 10 are located on the other side of the framework 11 relative to the steel parts 50, whereby the anode 20 cannot come into contact with the steel parts 50.

The invention has above been described only with reference to an example of its preferred embodiment. However, the intention is in no way to limit the invention to this example, but many changes and modifications are possible within the inventive idea defined in the following patent claims.

We claim:

1. An electrode arrangement to be used in the cathodic protection of concrete structures, comprising a framework having a plurality of open interior spaces extending from a first side of said framework to a second side of said framework opposed to said first side, said framework being made of an electrically insulating material or an electrolytically conductive material, a plurality of anodes, each of said anodes being arranged in a respective one of said open interior spaces and being attached to said framework, and fixing means attached to said framework for fixing said framework to steel parts of a structure to be cast with concrete, said fixing means being attachable to the steel parts to define a continuous open space into which concrete is to be poured, said anodes and the steel parts of the structure being situated in said continuous open space before concrete is poured therein such that a uniform and continuous concrete structure is formed between said anodes and the steel parts upon pouring of concrete into said continuous open space.

2. The arrangement of claim 1, wherein said framework is made of concrete.

3. The arrangement of claim 2, wherein said anodes mechanically fixed to said concrete framework.

4. The arrangement of claim 1, wherein said fixing means are concrete-reinforcement pins.

5. The arrangement of claim 1, wherein said anodes are placed on a first side of said framework and said fixing means are placed on an opposite side of said framework from said first side.

6. The arrangement of claim 1, further comprising a conductor to supply electricity to said anodes.

7. The arrangement of claim 1, wherein said framework is rigid and arranged to prevent electrical contact between said anodes and the steel parts in the structure during the casting of the structure.

8. An apparatus for use in the casting of a cast reinforced concrete structure to provide cathodic protection of reinforcing members of said concrete structure, comprising:

a plurality of anodes each having opposed sides and a lateral periphery bordering said sides, a framework connected to said anodes substantially at said lateral peripheries thereof such that said sides of said anodes are uncovered by said framework and openly exposed, and means for fixing said framework to at least one reinforcing member of a concrete structure to be cast prior to casting the concrete structure to form an assembly situated in a space for receiving poured concrete during the casting of the concrete structures such that upon the casting of the concrete structure, said sides of said anodes and said at least one reinforcing member are encapsulated in the poured concrete.

9. The device of claim 8, wherein said fixing means are concrete-reinforcement pins.

10. The device of claim 9, wherein said pins are fixed to said at least one reinforcing member.

11. The device of claim 8, further comprising a conductor to supply electricity to said anodes.

12. A concrete mold assembly for manufacturing a reinforced concrete structure having cathodic protection of reinforcing members of the structure, comprising a framework having first and second opposed sides and a plurality of open interior spaces extending from a first side of said framework to a second side of said framework opposed to said first side, a plurality of anodes, each of said anodes being situated in a respective one of said spaces on said first side of said framework, and fixing means arranged on said second side of said framework for attaching said framework to reinforcing members of a structure to be cast with concrete to form an assembly of said framework, anodes and reinforcing members, a form defining an interior space, said assembly of said framework, anodes and reinforcing members being situated in said interior space of said form such that said first side of said framework faces away from said reinforcing members, and said fixing means being attachable to said reinforcing members to define a continuous open space into which concrete is to be poured, said anodes and said reinforcing members being situated in said continuous open space before concrete is poured therein such that a uniform and continuous concrete structure is formed between said anodes and said reinforcing members upon pouring of concrete into said continuous open space.

13. A reinforced cast concrete assembly situated in a space for receiving poured concrete to form a concrete structure, comprising at least one reinforcing member, a plurality of anodes each having opposed sides and a lateral periphery bordering said sides, a framework connected to said anodes substantially at said lateral peripheries thereof such that said sides of said anodes are uncovered by said framework and openly exposed, and means for fixing said framework to said at least one reinforcing member prior to pouring concrete into the assembly such that upon pouring concrete into said space, said anodes, said at least one reinforcing member, said fixing means and said framework are all encapsulated in the poured concrete.

* * * * *